United States Patent [19]

Vogten et al.

[11] 4,374,302

[45] Feb. 15, 1983

[54] ARRANGEMENT AND METHOD FOR GENERATING A SPEECH SIGNAL

[75] Inventors: Leonardus L. M. Vogten; Leonardus F. Willems, both of Eindhoven, Netherlands

[73] Assignees: N.V. Philips' Gloeilampenfabrieken; Technische Hogeschool Eindhoven, both of Eindhoven, Netherlands

[21] Appl. No.: 216,000

[22] Filed: Dec. 12, 1980

[30] Foreign Application Priority Data

Jan. 21, 1980 [NL] Netherlands ..... 8000361

[51] Int. Cl.[3] ..... G10L 1/00

[52] U.S. Cl. ..... 179/1 SM

[58] Field of Search ..... 179/1 SM, 1 SA, 1 SC, 179/15.55 R, 15.55 T; 364/513, 514

[56] References Cited

U.S. PATENT DOCUMENTS

| | | | |
|---|---|---|---|
| 3,588,353 | 6/1971 | Martin | 179/1 SM |
| 3,641,496 | 2/1972 | Slavin | 179/1 SM |
| 3,892,919 | 7/1975 | Ichikawa | 179/1 SM |
| 4,301,329 | 11/1981 | Taguchi | 179/1 SA |

*Primary Examiner*—Emanuel S. Kemeny

*Attorney, Agent, or Firm*—Thomas A. Briody; William J. Streeter; Edward W. Goodman

[57] ABSTRACT

LPC-synthesizing device, in which a modulation of the synthesized signal with a window signal is used to reduce the buzz which is characteristic for such devices. This window signal has an amplitude which initially increases gradually from substantially zero value to a constant value, and then decreases gradually from the constant value to substantially zero value. As a result of this modulation the signal in the transition between two segments of voiced speech is forced to zero thereby eliminating any transition discontinuities, the existence of which causes the buzz.

6 Claims, 5 Drawing Figures

ARRANGEMENT AND METHOD FOR GENERATING A SPEECH SIGNAL

BACKGROUND OF THE INVENTION

The invention relates to an arrangement for generating a speech signal comprising a synthesizing section, based on the linear prediction, principle for producing a discrete signal consisting of a plurality of consecutive sub-signals, each representing a voiced or unvoiced speech segment, and an output section for converting the discrete signal into the speech signal.

The invention also relates to a method of generating a speech signal.

Arrangements of the type defined in the preamble are described in the book by J. D. Markel and A. H. Gray, Jr. entitled: "Linear Prediction of Speech" (Springer-Verlag 1976), chapter 5 of which describes the general structure of a speech synthesizing arrangement based on the linear predictive coding (LPC) principle, while chapter 10 describes the use of LPC techniques in vocoders.

An article by B. S. Atal and S. L. Hanauer entitled: "Speech Analyses and Synthesis by Linear Prediction of the Speech Wave" in The Journal of the Acoustical Society of America, volume 50, no. 2, 1971, pages 637–655 gives a clear description of an LPC speech synthesizing arrangement, which comprises an adaptive discrete filter whose pulse response is periodically changed on the basis of prediction parameters. Therein, a speech signal is produced at the output of the filter when there is applied to the input a pulse signal for voiced signals and a noise signal for unvoiced signals.

However, the speech signals generated by that type of arrangements have, as known, an annoying buzz in voiced portions of the speech signal.

To reduce this buzz in the synthesized speech signal, the literature mentions several possibilities. Inter alia M. R. Sambur et al. propose, in an article in the Journal of the Acoustical Society of America, Volume 63, no. 3, March 1978, pages 918–924 entitled: "On reducing the buzz in LPC synthesis", to use a pulse having a very special shape with rounded edges instead of, as customary, an impulse for exciting the discrete filter. Although this does indeed effect some improvement, applicants have found that this improvement is rather slight and that the speech signal gets a considerable low-pass character.

SUMMARY OF THE INVENTION

It is an object of the invention to realize a reduction of the buzz in a relatively simple manner, while avoiding considerable low-pass filtration as much as possible.

The arrangement according to the invention is therefore characterized in that the output section comprises means for modulating the subsignals of the discrete signal corresponding to varied signals with a window signal, the duration of which corresponds to the duration of a sub-signal, the amplitude of which increases first gradually from substantially zero value to a constant value, and decreases thereafter gradually to substantially zero value, so that at the instant of transition from one sub-signal to a next sub-signal, the amplitude of the speech signal is substantially zero.

DESCRIPTION OF THE DRAWINGS

Embodiments of the arrangement according to the invention will now be further explained by way of example with reference to the accompanying drawings. In these drawings.

DESCRIPTION OF THE PREFERRED EMBODIMENT

Figure 1:
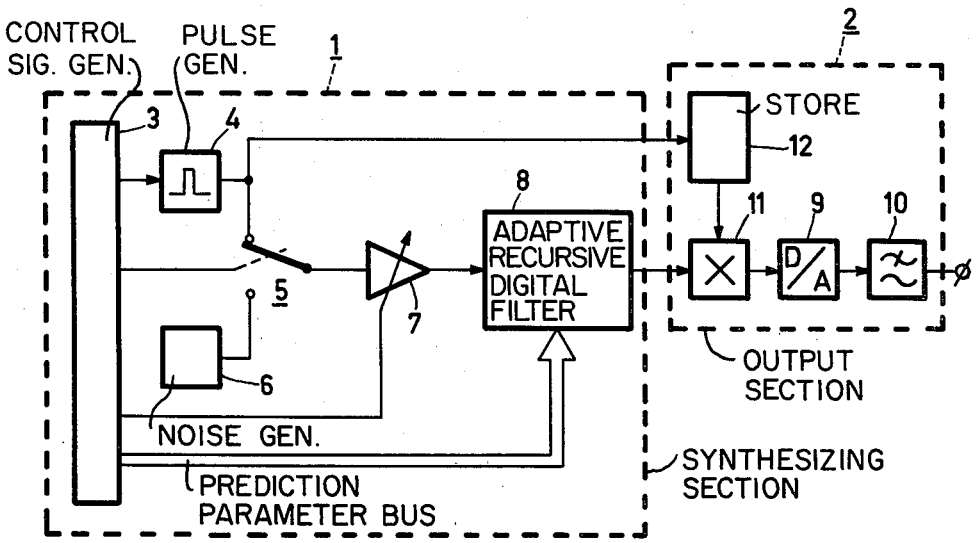
FIG. 1 shows a first embodiment in which the modulation with the window signal is carried out in a digital manner.

The arrangement shown in FIG. 1 comprises a synthesizing section 1, based on the linear prediction principle, which applies a digital signal to an output section 2. The synthesizing section 1 comprises a control signal generator 3 for producing a number of control signals and a pulse generator 4, a voiced-unvoiced switch 5, a noise generator 6, a controllable amplifier 7 and an adaptive recursive digital filter 8. For synthesizing voiced speech signals, the switch 5 connects an output of the pulse generator 4 to an input of the controllable amplifier 7 and for synthesizing unvoiced speech signals, an output of the noise generator 6 is connected to the input of amplifier 7. As the signals produced by the pulse generator 4 and the noise generator 6 have a standard amplitude, the amplitude is adjusted, by means of the controllable amplifier 7, to a value which is suitable for the speech segment to be synthesized. The output signal of amplifier 7 is applied to the filter 8 as the excitation signal. The control signal generator 3 may, for example, be formed by a store in which the control signals, which were obtained on the basis of a preceding analysis of a speed signal, have been stored. These control signals are: the period of the fundamental tone which controls the pulse generator 4, a binary voiced-unvoiced parameter, which controls switch 5, the value of the amplitude for setting the controllable amplifier 7 and a number of prediction parameters which determine the coefficients of the adaptive recursive digital filter 8. In response to the output signal of amplifier 7, the filter 8 produces a digital signal which is converted into a speech signal by means of a digital-to-analog converter 9 and a low-pass filter 10 in the output section 2.

The control signals of the control signal generator 3 are changed in synchronism with the period of the fundamental tone for voiced speech and with a fixed period of, for example, 10 msec. for unvoiced speech. After each change in the control signals, the filter 8 produces a sub-signal which characterizes a speech segment either with a duration equal to the then prevailing period of the fundamental tone, when voiced speech is concerned, or with a duration equal to the fixed period (10 msec) in the case of unvoiced speech.

It should be noted that it is alternatively possible to change the control signals of the control signal generator 3 not in synchronism with the period of the fundamental tone, but independent thereof. In that case the filter 8 will not produce a sub-signal after each change in the control signals. Therefore, the expression "sub-signal" must be understood to mean that portion of the digital signal produced by the filter 8 that characterizes a speech segment.

As was found by applicants, discontinuities occur at the transition from one sub-signal to a next sub-signal which, in the opinion of applicants, cause the above-mentioned buzz in the voiced portions of the speech signal.

According to the invention, the buzz is reduced in the embodiment shown in FIG. 1 by applying the sub-signals to a multiplier 11, for multiplying the sub-signals, which correspond with a voiced speech segment, by a window signal. To that end, a digital representation of the window signal is stored in a store 12 which is also connected to the amplifier 11.

Applying the window signal from the store 12 to the amplifier 11 must be done in synchronism with the occurrence of the sub-signals for voiced speech. To that end, the output signal of the pulse generator 4 is applied as a synchronizing signal to the store 12.

Figure 2:
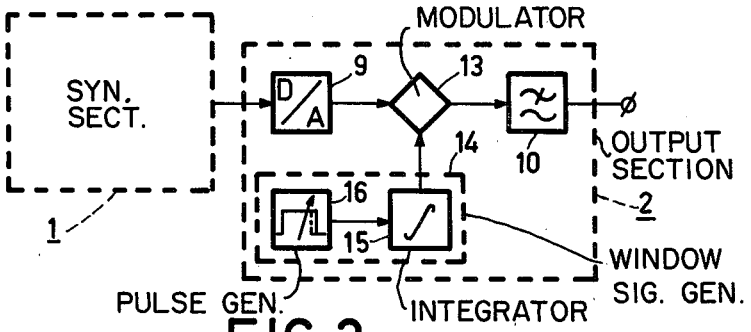
FIG. 2 shows a second embodiment in which the modulation is carried out in the analog mode.

The embodiment shown in FIG. 2 also comprises a synthesizing section 1 which is based on the linear prediction principle and which applies a digital signal to an output section 2. The synthesizing section 1 is constructed in a manner already described with reference to FIG. 1. However, the modulation of the sub-signals with the window signal is here carried out in an analog mode by first converting the digital signal by means of a digital-to-analog converter 9 into an analog signal which is thereafter applied to an analog modulator 13. The window signal, which is generated by a window signal generator 14, is then applied to the analog modulator 13. The window signal generator 14 is comprised of an integrator 15 and a pulse generator 16, connected to the input thereof, this pulse generator 16 supplying pulses with a duration which depends on the period of the fundamental tone.

To obtain the required synthronization between the window signal and the output signal of the digital-to-analog converter 9, not only the duration of the pulses produced by the pulse generator 16 but also the instant those pulses occur must be in synchronism with the period of the fundamental tone.

Figure 3A:
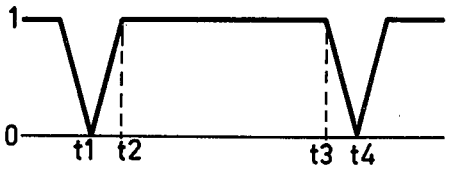
FIGS. 3A and 3B show two possible shapes of the window signal.
Figure 3B:
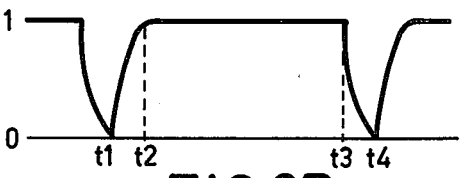

The FIGS. 3A and 3B show two possible forms of the window signal. The variation of the time is plotted on the horizontal line and the amplitude on the vertical line. The amplitude varies from 0 to 1, wherein it should be noted that a value, deviating from the value 1 between the instants t2 and t3, only results in a linear amplification, or attenuation, of the speech signal. For both forms it holds that the duration between the instants t1 and t4 is equal to the duration of the period of the fundamental tone of the speech signal. For a fundamental tone of 100 Hz this means a duration of 10 msec. A proper choice for the rise and fall times of the window signal appears to be to the order of 1 msec, so that during aproximately 80% of the time, the voiced speech signals are not changed by the modulation with the window signal. The form shown in FIG. 3B shows the variation of a window signal which is generated by means of a window signal generator as shown in FIG. 2. It should be noted that the beginning of the window signal (t1) coincides with the leading edge of the pulse generated by the pulse generator 16, while the decrease in the window signal is initiated at the instant t3 with the trailing edge of the generated pulse.

Figure 4:
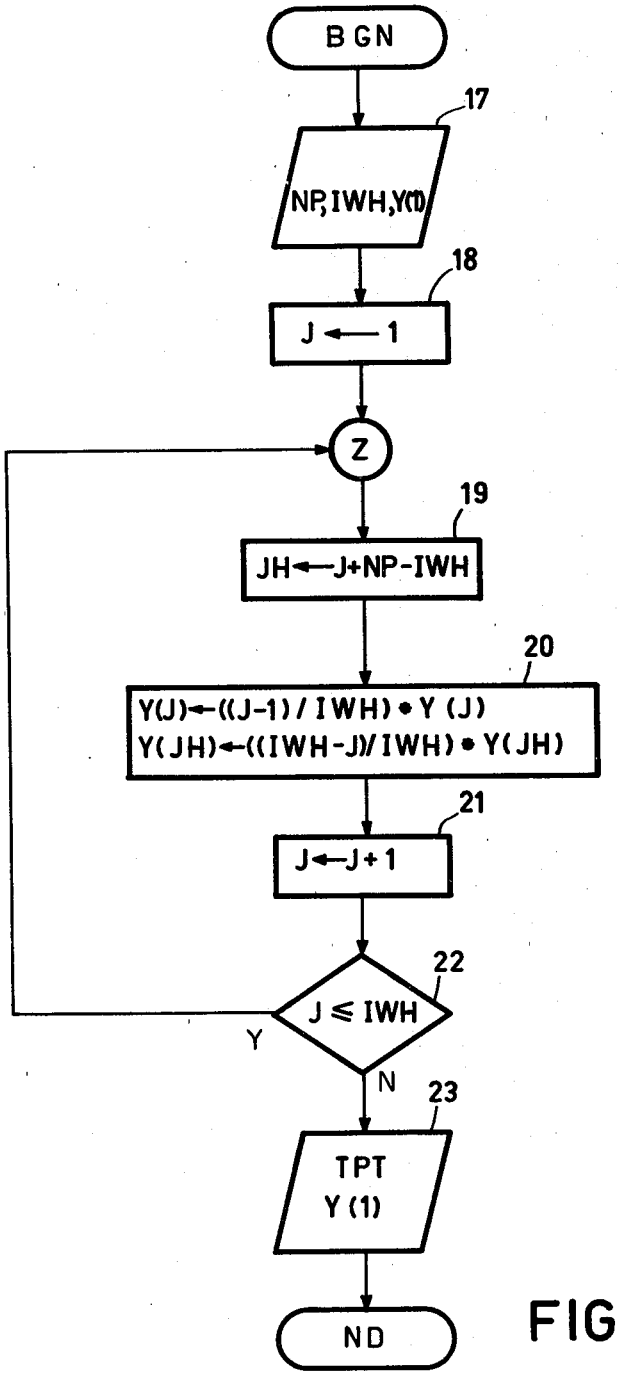
FIG. 4 is a flow-chart of the manner in which the modulation can be carried-out in a digital calculator.

In practice, the synthesizing section of the described arrangement is often realized in a digital computer, which produces the digital signal under control of a synthesizing program. An example of such a program can be found in the above-mentioned book by J. D. Markel and A. H. Gray, Jr, in chapter 10, paragraph 10.2.5. In such a realization, the modulation with a window signal can be implemented in a particularly simple manner by means of a program. FIG. 4 shows a flow chart of such a program, a modulation being carried-out with a window signal as shown in FIG. 3A.

The program starts at block 17 by the insertion of the numbers NP, IWH and Y(1). Herein NP is the number of words in a sub-signal, and the range Y(1) to Y(NP) inclusive indicates the value of these words. IWH indicates over how many words of the sub-signal the slope of the window signal extends. In block 18 the value of the running variable J is set equal to 1. In block 19 the value J+NP-IWH is alloted to the auxiliary variable JH. For a certain value of J, block 20 gives the multiplication of a word of the sub-signal by the magnitude of the window signal. In block 21 the value of J is increased by one and in the decision diamond 22 the new value of J is compared with IWH. The multiplication process goes on until J is equal to IWH+1, whereafter the modulated sub-signal is represented by the new sequence Y(1) to Y(NP) and is led out at block 23 for further processing by the digital-to-analog converter in the output section. A practical value for IWH, with which good results were obtained, is 10, which for a sampling frequency of 10 kHz corresponds to a rise and fall time for the window signal of 1 msec each.

As the energy of the speech signal has decreased by the use of the described modulation method, the signal must still be corrected after modulation to obtain the correct level. This can be done in a simple manner by including some additional steps in the program for the digital computer, each word of the modulated sub-signal being multiplied by a factor which is equal to the square root of the ratio between the energy prior to and the energy after modulation.

It should be noted that instead of the digital signal in the embodiments shown in the FIGS. 1 and 2, it is also possible to use only time-discrete signals, provided the components suitable therefor are used, such as, for example, components built-up by means of Charge Coupled Devices (CCD's).

What is claimed is:

1. An arrangement for generating a speech signal comprising a synthesizing section based on the linear prediction principle of producing a discrete signal consisting of a plurality of consecutive sub-signals, each representing a voiced or unvoiced speech segment, and an output section for converting the discrete signal into the speech signal, characterized in that the output section comprises means for modulating the sub-signals of the discrete signal corresponding to voiced speech segments with a window signal, the duration of which corresponds to the duration of a sub-signal and the amplitude of which increases first gradually from substantially zero value to a constant value decreases thereafter gradually to substantially zero value, so that at the instant of transistion from one sub-signal to a next sub-signal the amplitude of the speech signal is substantially zero.

2. An arrangement as claimed in claim 1, characterized in that the said means comprises a multiplier having a first input for receiving the consecutive sub-signals and a second input connected to an output of a storage device in which a discrete representation of the window signal has been stored.

3. An arrangement as claimed in claim 1, wherein the discrete signal is a digital signal and said arrangement comprises a digital computer which, under the control of a synthesizing program, produces said digital signal, characterized in that said modulating means is part of the digital computer and the modulation is effected by modifying said digital signal under the control of a program.

4. An arrangement as claimed in claim 1, characterized in that said modulating means comprises an analog modulator having a first and a second input, a digital-to-analog converter connected to said first input, which converts the discrete signal, produced by the synthesizing section, into an analog signal, and a window signal generator which is connected to said second input.

5. An arrangement as claimed in one of the preceding claims, characterized in that the increase and the decrease of the window signal are uniform and constant for each unit of time.

6. A method of generating a speech signal in which, on the basis of a plurality of control signals obtained by means of linear prediction, a discrete signal, consisting of a plurality of consecutive sub-signals, each representing a voiced or unvoiced speech segment and from which the speech signal is obtained after low-pass filtration, is produced by an adaptive recursive filter, characterized in that the method comprises, prior to the low-pass filtration, the step of reducing to zero the amplitude of the signal to be filtered, corresponding to voiced speech segments, at the instant of transition from one sub-signal to a next sub-signal.

* * * * *